United States Patent [19]

Osteen

[11] Patent Number: 5,036,445

[45] Date of Patent: Jul. 30, 1991

[54] MEANS AND METHOD FOR CONTROLLING THE UPLIGHTING PROPERTIES OF A LUMINAIRE HAVING A REFLECTOR OF SUBSTANTIALLY TRANSPARENT MATERIAL WITH A PRISMATIC OUTER SURFACE

[75] Inventor: Mitchell M. Osteen, Zirconia, N.C.

[73] Assignee: General Electric Company, Schenectady, N.Y.

[21] Appl. No.: 482,127

[22] Filed: Feb. 20, 1990

Related U.S. Application Data

[63] Continuation-in-part of Ser. No. 281,117, Dec. 7, 1988, Pat. No. 4,903,180.

[51] Int. Cl.[5] ..... F21V 7/22; F21V 5/02

[52] U.S. Cl. ..... 362/348; 362/296; 362/337; 362/376; 428/325

[58] Field of Search ..... 362/296, 307, 341, 347, 362/348, 350, 376, 378, 337, 339, 340; 428/325, 412, 433, 913

[56] References Cited

U.S. PATENT DOCUMENTS

| | | | |
|---|---|---|---|
| 1,259,493 | 3/1918 | Dorey | 362/337 |
| 1,758,977 | 5/1930 | Rolph | 362/337 |
| 2,354,048 | 7/1944 | Palmquist | 362/812 |
| 2,818,500 | 12/1957 | Franck | 362/337 |
| 3,705,303 | 12/1972 | Willis et al. | 240/93 |
| 4,118,763 | 10/1978 | Osteen | 362/339 |
| 4,432,045 | 2/1984 | Merritt | 362/376 X |
| 4,460,945 | 7/1984 | Chan et al. | 362/376 |
| 4,808,471 | 2/1989 | Grunzinger | 428/325 |
| 4,904,525 | 2/1990 | Taniguchi et al. | 428/412 X |
| 4,933,227 | 6/1990 | Stewart | 428/412 X |

*Primary Examiner*—Ira S. Lazarus
*Assistant Examiner*—Peggy A. Neils
*Attorney, Agent, or Firm*—George E. Hawranko; John P. McMahon; Stanley C. Corwin

[57] ABSTRACT

This luminaire has a reflector of substantially transparent material that is adapted to surround a light source. The reflector has many double-reflector right-angle prisms on its outer surface, each characterized by having two reflecting surfaces disposed to effect total internal reflection of a large percentage of the light from the source entering the prism. For controlling the amount of light passing from the source through the prismatic outer surfaces of the reflector, an additive in particle form is dispersed within the transparent reflector material and serves to divert some of the light rays entering the prisms into paths that intersect the reflecting surfaces at angles less than the critical angle of incidence, thereby causing said diverted rays to pass through the prismatic outer surface.

20 Claims, 3 Drawing Sheets

MEANS AND METHOD FOR CONTROLLING THE UPLIGHTING PROPERTIES OF A LUMINAIRE HAVING A REFLECTOR OF SUBSTANTIALLY TRANSPARENT MATERIAL WITH A PRISMATIC OUTER SURFACE

CROSS-REFERENCE TO RELATED APPLICATION

This application is a continuation-in-part of co-pending application Ser. No. 281,117 - Osteen et al, filed on Dec. 7, 1988 now U.S. Pat. No. 4,903,180, and to the assignee of the present invention which application is incorporated by reference into the present application.

BACKGROUND

This invention relates to a luminaire and, more particularly, to a luminaire of the type in which there is provided about a light source a reflector of substantially transparent material having a prismatic outer surface comprising many double-reflecting prisms with reflecting surfaces oriented to effect total internal reflection of light from the light source. The invention also relates to means for and a method for controlling the amount of light from said source that is allowed to pass through said prismatic outer surface and thus produce uplight.

Luminaires that rely upon prismatic reflectors of the above type are conventional and are disclosed in the following exemplary U.S. Pat. Nos. 2,818,500-Franck; 1,259,493-Dorey; and 1,758,977-Rolph. These prismatic reflectors rely upon the principle of total internal reflection of visible light at a glass-to-air interface when the light is incident upon that surface at an angle greater than the critical angle of incidence, which for a glass-to-air interface is typically about 42°. Typically, each prism has two reflecting surfaces, each of which reflects light onto the other, and each being oriented to provide an incidence angle of greater than the critical angle with respect to light incident thereon. The reflecting surfaces of each of these prisms meet at an apex, and the adjacent reflecting surfaces of juxtaposed prisms meet in a valley between the prisms at the nadir of the valley.

A disadvantage of this type of reflector is that if a non-uniform film is allowed to deposit on the prismatic surface, the desired reflecting properties of the surface may be significantly degraded, especially if the film is partially or fully light-absorbing. If the deposit is not uniform, it effectively changes the incidence angle of light rays striking the relevant interface of the prism with the adjacent air and may let light through this first interface or may change the angle of reflection so much at the first interface that the incidence angle at the second interface is less than the required critical angle, thereby letting light pass through at the second interface.

Another characteristic of prismatic reflectors of the above type is that a substantial amount of light will pass through the reflector even though the reflecting surfaces of the prisms are clean. One reason for this is that the molds typically used for making the prismatic reflectors are not precise enough to achieve mathematical precision of the reflecting surfaces all the way to the apices of the prisms and to the nadir of the valleys between them; and, consequently, light leakage will occur in these regions. Additional light leakage can occur at points of defects in the prism surfaces, which points may be present as a result of mold imperfections or even designed-in defects. Altogether, this light leakage can typically amount to about 20% of the lumen output of the luminaire. In certain luminaire applications, specifically, those with bare reflectors, this light leakage has been advantageously employed to provide uplight, so as to reduce ceiling contrast and to illuminate overhead structures.

The amount of uplighting required from a luminaire will often differ from one lighting application to another. It is therefore desirable that some means be available to the luminaire designer to enable him to change the amount of uplighting, depending upon the particular application. One way that this can be achieved is by intentionally molding defects into the prisms (as is disclosed, for example, in U.S. Pat. No. 4,118,763 - Osteen, assigned to the assignee of the present invention). Corresponding irregularities can be built into the molds used for making the reflector, and these will consistently produce the desired defects in the molded glass or plastic prism structure. A disadvantage of relying upon this approach alone is that once the mold is finished, the amount of uplighting available from the reflector to be molded is fixed, thus restricting the number of applications with different uplighting requirements for which these molds can be used.

Another possible way of increasing uplighting is to add blemishes to the already molded reflector in its active prism area by some approach such as sand blasting, scratching, or etching. In each case this involves a secondary operation that is relatively difficult to adequately control and may result in a rather unsightly finished reflector.

OBJECTS

An object of my invention is to provide, for controlling the amount of light passing through the prismatic outer surface of a reflector having total internal reflecting prisms, means that is readily incorporable into the reflector and that readily lends itself to changes that permit the passage of preselected different amounts of light from one reflector to another.

Another object is to provide means capable of fulfilling the immediately-preceding object and also requiring for this purpose no change to the mold or to the reflector after completion of the molding operation.

Another object is to provide a method for controlling the amount of light through a reflector of this type which is simple and readily lends itself to precise control of this light amount.

Still another object is to provide a method of this character which requires no change to the mold or to the molded reflector in order to change the amount of light passing through the prismatic outer surface of the reflector.

Another object is to maintain relatively unchanged the preselected amount of light from the source passing through the prismatic outer surface of the reflector once the reflector has been installed

SUMMARY

In carrying out the invention in one form, there is provided a luminaire that comprises a reflector of substantially transparent material and means for mounting a light source within the reflector. The reflector has a prismatic outer surface that has many prisms located at juxtaposed spaced locations along the outer surface. The prisms are double reflecting prisms that individually are characterized by having a pair of reflecting surfaces that are disposed so that a large percentage of the rays from the source entering the prism strike the reflecting surfaces at angles of incidence greater than the critical angle of incidence, thereby totally internally reflecting a large percentage of such light from the source. I control the amount of light passing from the source through the prismatic outer surface by means of an additive in particle form dispersed within said transparent reflector material and serving to divert light rays from the source into paths that intersect said reflective surfaces at angles less than said critical angle of incidence. The effect of such diversion is to cause the diverted rays to pass through said prismatic outer surface and, thus, to produce up-light.

In practicing the method of my invention in one form, I add said particles to the material of the reflector when said reflector material is in miscible state prior to molding of the reflector. I also disperse said particles throughout the reflector material while the material is still in its miscible state, thereby effecting the desired dispersion of said particles. When using an injection molding process for forming the reflector, such dispersion is readily effected by the action of the usual injection screw as the material is being injected into the mold. By adjusting the quantity of particles added, 1 can effectively adjust the amount of light that will be allowed passage through the prismatic outer surface of the reflector

BRIEF DESCRIPTION OF DRAWINGS

For a better understanding of the invention, reference may be had to the following detailed description, taken in conjunction with the accompanying drawings, wherein.

DETAILED DESCRIPTION OF ILLUSTRATED EMBODIMENT

Figure 1:
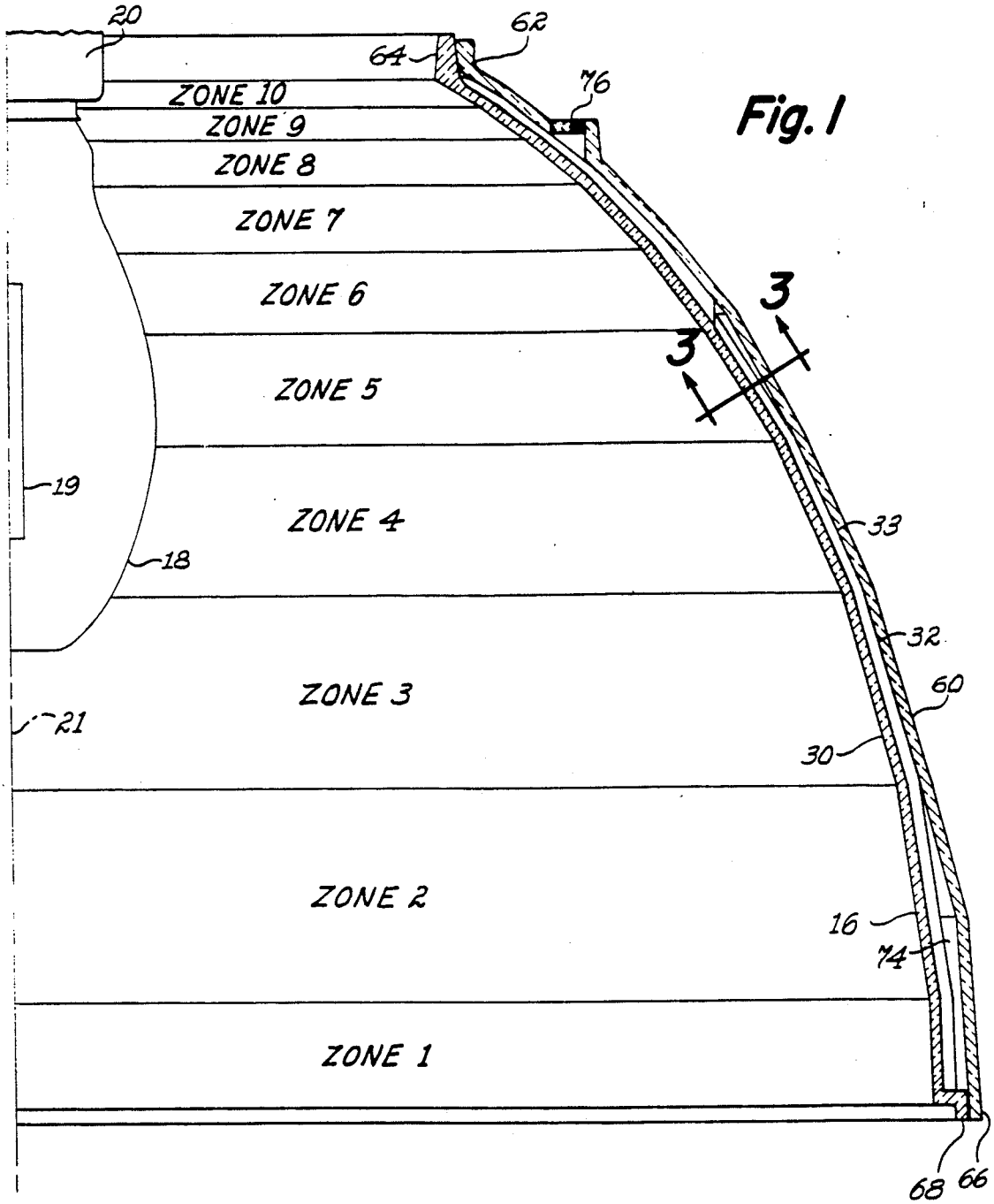
FIG. 1 is a sectional view of a portion of a luminaire embodying one form of my invention. This luminaire includes a reflector 16 and a cover 60 surrounding the reflector.
Figure 3:
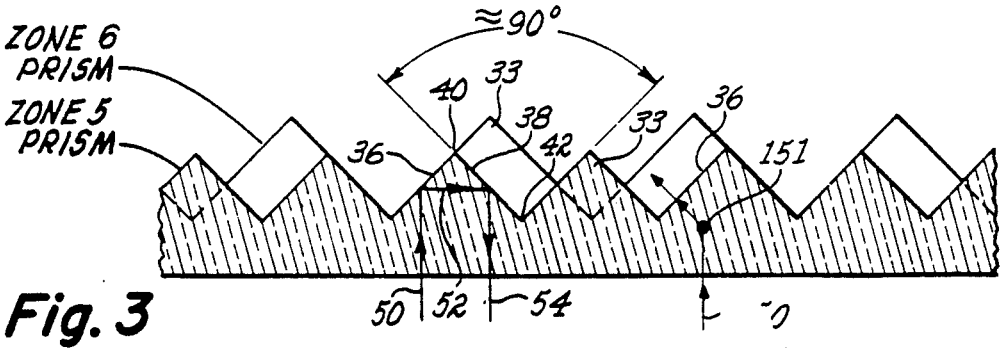
FIG. 3 is an enlarged sectional view along the line 3—3 of FIG. 1, but with the cover removed and with the depicted accurate portion of the reflector unrolled.
Figure 2:
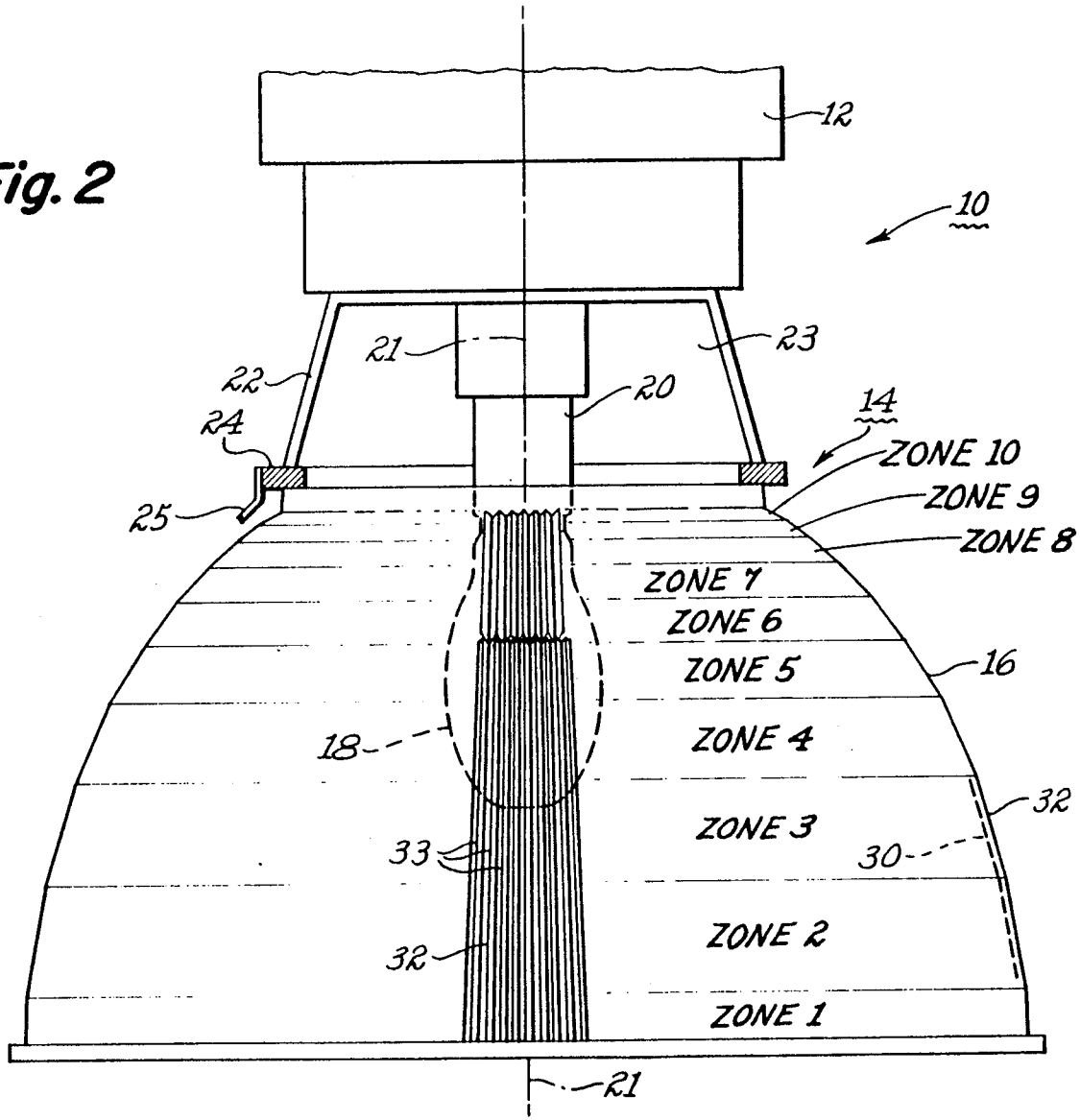
FIG. 2 is a side elevational view, partly schematic, of the luminaire of FIG. 1, with the dome-shaped reflector of FIG. 1 shown in full lines but with its cover removed.

The luminaire of FIGS. 1–3 correspond in many respects to the luminaire of the aforesaid application Ser. No. 281,117, Osteen et al, and corresponding reference characters have been used to designate corresponding parts.

Referring now to FIG. 2, there is shown an industrial luminaire 10 comprising a ballast housing 12 having suspended from the bottom thereof an oPtical assembly 14. The optical assembly comprises a dome-shaped reflector 16 of transparent material, such as a suitable glass or a suitable acrylic resin. Within the reflector 16 is mounted a lamp 18, typically of the gaseous discharge type, removably secured to a lamp holder or socket 20 so as to extend into the reflector along the central vertical axis 21 of the reflector. Referring to FIG. 1, the lamp is schematically illustrated as including an arc tube, or source, 19 on the central vertical axis 21. It is to be understood that the invention is also applicable to luminaires that include other types of lamps, for example, suitable incandescent lamps.

The reflector 16 is supported on the ballast housing 12 by yoke structure 22 that has large openings 23 therein to permit full ventilation of the reflector by chimney action. More specifically, air is able to flow upwardly through the open bottom of the reflector, then upwardly through the reflector through its upper end, and then through the openings 23 in the yoke 22. Additional support for the reflector 16 may be provided by three generally vertically-extending rods (one of which is partially shown at 25 in FIG. 2) which are located outside the reflector and are angularly spaced about the reflector periphery. These rods are attached at their lower ends to suitable radially-extending projections on an annular retaining ring (not shown) at the bottom of the reflector and at their upper ends to a ring 24 forming a part of yoke 22.

Referring to FIGS. 1 and 2, the dome-shaped reflector 16 comprises a series of superimposed integrally-connected sections, each of a truncated conical form and each merging smoothly with the smaller diameter section immediately above it. Each truncated conical section tapers to a progressively greater extent than the one beneath it. The truncated conical sections are respectively located in superposed regions of the dome designated zones 1 through 10.

The dome-shaped reflector 16 has a smooth inner surface 30 and a prismatic outer surface 32. This outer surface comprises a large number of double-reflecting right-angle prisms 33 shown in the central portion of FIG. 2, each extending in a plane that includes the longitudinal axis of the reflector, or vertically when viewed from the edge of such a plane, as shown in FIG. 2.

In one embodiment of the invention, the reflector has a 25.2 inch outer diameter at its bottom and 360 juxtaposed external prisms 33 equally angularly spaced at one-degree intervals about the external periphery of the reflector in Zones 1 through 5. In Zones 6 and 7, there are 240 double reflecting external prisms of generally the same form equally spaced at 1.5 degree intervals about the outer periphery. The relationship of the prisms in Zone 5 as compared to Zone 6 is best shown in FIG. 3, where it can be seen that the prisms of Zone 6 (shown partially in phantom) project a slightly greater distance from the remainder of the external surface than is the case with the prisms in Zone 5. In Zones 8, 9 and 10, there are 240 prisms 33 equally spaced by 1.5 degrees about the outer periphery.

Referring to FIG. 3, each of the prisms 33 has two reflecting surfaces 36 and 38 that intersect at an apex 40. The reflecting surfaces 36 and 38 of immediately-adjacent prisms intersect at a valley nadir 42. To facilitate manufacture of the reflector, a small radius of curvature is present at each apex 40 and in each valley nadir 42. The reflector is preferable made by pressing or molding a suitable glass or plastic (e.g., acrylic) compound (while hot and in a plastic or semi-liquid state) into a concave mold having flutes in its active surface for forming the prisms, and it is not feasible to achieve great enough precision in the mold to produce intersection of the reflecting surfaces 36, 38 along perfect zero-width lines, hence the rounding that is present in these regions.

In the illustrated reflector, the reflecting surfaces 36 and 38 of the prisms are so oriented that most of the rays of light from the source striking the reflector are incidence to these surfaces at incidence angles greater than the critical angle of incidence, i.e., the minimum incidence angle at which total internal reilection occurs. A typical path for the light rays is illustrated in FIG. 3, where the ray 50 from the source is totally internally reflected off the surface 36 as a ray 52 which strikes the surface 38, where it is totally internally reflected as a ray 54. Total internal reflection occurs at a borosilicate glass-to-air interface when the incidence angle is greater than about 42 degrees, assuming the glass has an index of refraction of about 1.5. For an acrylic compound, the critical angle of incidence is also about 42 degrees. In the illustrated prism, the incidence angles of the rays 50 and 52 at the surfaces 36 and 38 are each about 45 degrees. This relationship is achieved by making the angle between the juxtaposed prism reflecting surfaces about 90 degrees.

In a reflector with totally-reflecting external prisms oriented as illustrated, the reflector directs the rays internally reflected from the outer prismatic surface downwardly through the open end of the reflector via generally the same paths as would be followed by rays reflected off a smooth metal reflector of essentially the same shape and size as internal surface 30 of reflector 16.

While a major portion of the light striking the reflector is totally internally reflected, as above described, a substantial portion is not. Some of it passes through the reflector in the regions of the rounded apices 40 and valley nadirs 42, and some also passes through in regions where the prisms have surface defects, e.g., from imperfections in the molding apparatus or process. As will soon be described in more detail, I utilize this light leakage to produce uplight in the vicinity of the luminaire. In an industrial application, such uplight serves the desirable purpose of reducing ceiling contrast and illuminating nearby overhead structures.

As pointed cut in the SUMMARY portion of this application, I further control the amount of light that is permitted to pass through the reflector 16 by including within the transparent material of the reflector dispersed solid particles that are effective to divert some of the light rays from the source entering this material into paths that intersect the reflective surfaces 36 and 38 at angles less than the critical angle of incidence. More details regarding this feature will appear hereinafter.

To maintain the desired light output and distribution in the region beneath the luminaire, it is highly desirable that the reflecting surfaces 36 and 38 of the prisms be maintained free of non-uniform films and other deposits, especially if these deposits are partially or fully light-absorbing. If the deposit is not uniform, it effectively changes the incidence angle for the light rays impinging against the relevant interface at the deposit, and this may let light through this region of the reflector, or it may change the angle of reflection so much at the first interface (e.g., 36) that the incidence angle at the second interface (e.g., 38) is less than the required critical angle, thereby letting light pass through at this second interface. Such leakage of light, resulting from the build-up of deposits on the prisms, tends to unpredictably reduce the light output into the region beneath the luminaire.

To protect the reflecting surfaces 36 and 38 of the prisms 33 from such deposits, we surround the exterior prismatic surface 32 of the reflector with a form-fitting cover 60 of transparent material, such as a suitable plastic or glass. In the illustrated embodiment, this cover 60 is made by vacuum-forming clear sheet plastic around the prismatic reflector 16, sizing the cover so that it touches the prisms 33 only at their apices 40. The cover 60, at its upper end, is formed with a vertically-extending annular flange 62 that tightly surrounds a vertically-extending annular flange 64 at the top of the reflector 16 and integral with the reflector. Reflector flange 64 has a smooth circular external periphery to enhance the fit between it and the surrounding flange 62 of the cover.

At its lower end, the cover 60 is formed with an annular portion 66 that tightly surrounds an annular flange 68 of the reflector, this flange 68 also having a smooth circular external periphery to enhance the fit between it and the cover portion (66) surrounding it. There are no external prisms on the reflector on the short flanges 64 and 68 at the extremities of the reflector.

Because the cover 60 completely surrounds the exterior surface of the reflector, it protects this exterior surface from the deposition thereon of films and other contaminants from the surrounding atmosphere The protection provided by the cover 60 is enhanced by the relatively tight fit between the cover 60 and the reflector at the extreme end flanges 64 and 68 of the reflector The tight fit in these regions impedes the entry of air from the surrounding atmosphere into the space 74 between the reflector 16 and the cover 60.

This space 74 is not, however, sealed. It is allowed, in effect, to breathe in response to temperature changes of the reflector and the cover. Such breathing, for the most part, takes place through a low pressure drop filter 76, which, in the illustrated embodiment, is located in a passageway provided in the cover 60. The filter acts in a conventional manner to remove from the entering air most of the contaminants that could form deposits on the exterior surface of the reflector 16.

The above-described protection of the prismatic exterior surface 32 of the reflector 16 is obtained without significantly interfering with the desired uplighting abilities of the reflector inasmuch as the cover 60 is made of a substantially transparent material. Light that leaks through reflector 16 is transmitted through the cover and can be effectively utilized to provide the desired uplight.

It is to be noted that the cover 60, although in contact with the reflector 16, does not significantly interfere with the internal reflecting properties of the reflector. This is made possible by the fact that the cover 60 contacts the prisms 60 only at their apices 40. Since light is already passing through the prismatic reflector at these locations, the reflector's internal reflecting properties remain essentially unchanged despite such contact at the apices.

Each reflecting surface 36 or 38 of each prism may be thought of as comprising an active reflecting portion and two edge portions at opposite edges of the active reflecting portion, one edge portion being located at the apex 40 of the prism and the other at the nadir 42 of the valley. The cover 60 is out of contact with the active reflecting portions of the prisms, touching the prisms only at their apices 40.

In one embodiment of the invention, the cover 60 is vacuum formed from a ⅛-inch thick sheet of clear acrylic resin. Other clear plastics can be utilized, but they must be capable of withstanding without damage the elevated temperatures produced by the light source during operation of the luminaire. Reference may be had to the aforesaid application Ser. No. 281,117 for more details as to how the cover 60 is made, as well as more details of the cover itself.

As pointed out hereinabove, the amount of uplighting required from a luminaire will often differ from one lighting application to another. In accordance with the present invention, 1 control the amount of such uplighting by adding a small amount of light-dispersing material to the material of the reflector while this reflector material is still in a miscible, or non-solid, state prior to molding of the reflector. In one embodiment, the light-dispersing material comprises solid particles of a material having a different index of refraction from the reflector material. In another embodiment, the light-dispersing material comprises solid particles of a reflective material. In still another embodiment, a combination of these two types of particles is used. In one embodiment, the particles, before being introduced, are suspended in a liquid carrier, and this combination of carrier and particles is then introduced into the glass or plastic reflector material while the reflector material is still in a liquid or semi-liquid form. Then the liquid or semi-liquid glass or plastic is stirred or otherwise suitably agitated to disperse the added particles throughout, following which molding of the reflector is effected in a conventional manner.

In another embodiment, the reflector is made by injection molding acrylic resin. At an early stage in this injection molding process, the particles are added to the molding compound while the molding compound is still in its powdered or granular state. The resulting composite material is injected by the usual injection feed screw through a heating chamber and then into the mold. The action of the feed screw during such injection effectively disperses the particle additive throughout the resin that is injected into the mold.

Figure 4:
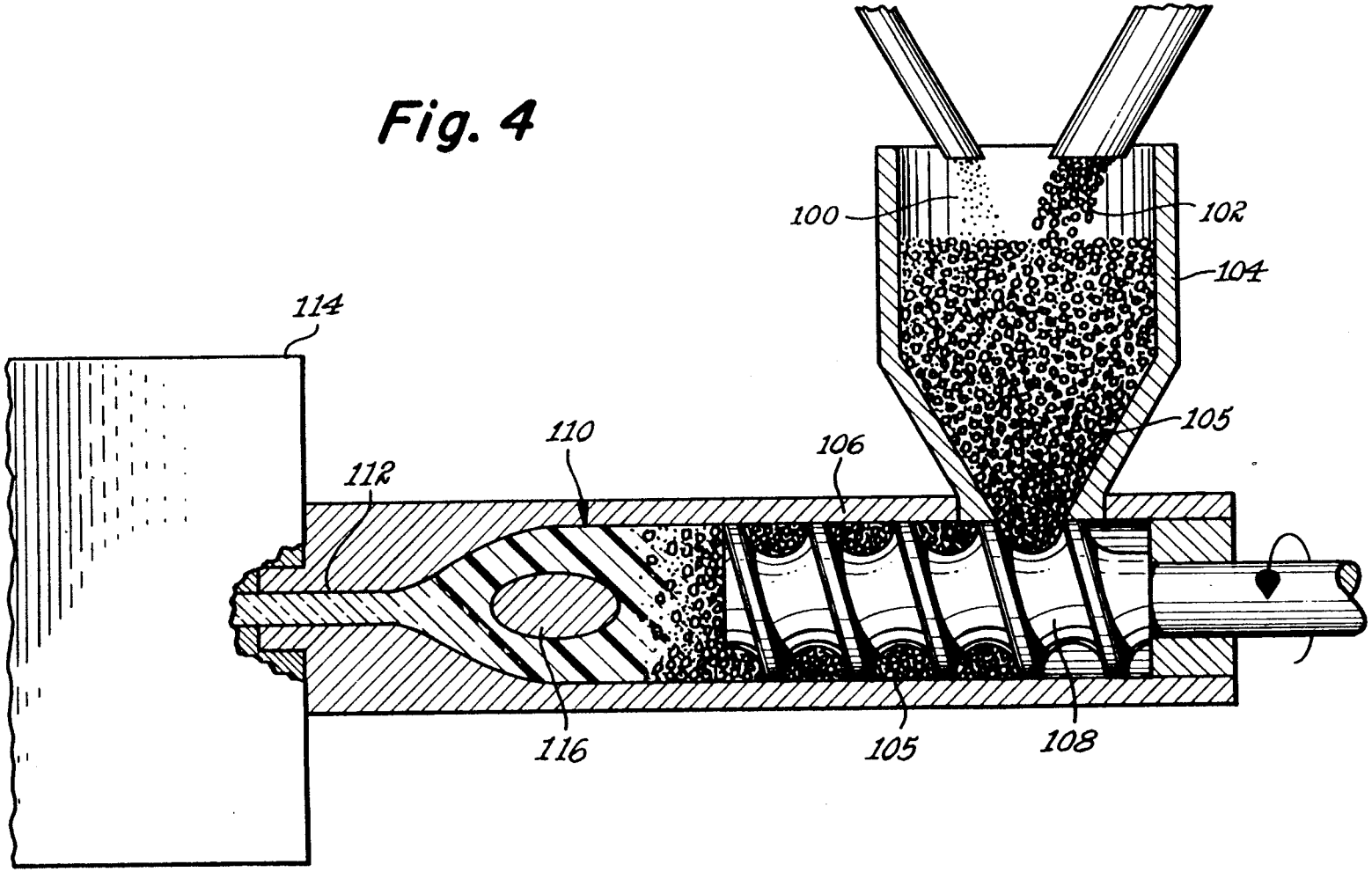
FIG. 4 is a schematic showing of injection molding apparatus used in practicing one form of the method of my invention.

This latter embodiment is schematically illustrated in FIG. 4, where the particle additive 100 is added to the granular acrylic molding compound 102 as the molding compound is being fed into a hopper 104. The resulting composite material 105 is fed from the hopper into the housing 106 for the feed screw 108. Rotation of the feed screw 108 forces the composite material downstream under high pressure into a heating chamber 110 where it is plasticized as it passes therethrough, finally exiting through an injection nozzle 112 leading to the mold 114.

Rotation of the feed screw acts to effectively disperse the particle additive throughout the granular, still-miscible base material as the screw rotates. The heating chamber 110 is surrounded by suitable heating means, and a spreader 116 within the heating chamber forces the material therein close to the cylindrical wall of the chamber to effect more uniform heating of this material.

In the finished reflector, the particles serve to divert some of the light rays from the source entering the reflector material into paths that intersect the prism surfaces 36 or 38 at angles of incidence less than the critical angle of incidence. This results in such light rays passing through the prism surfaces and thus producing the desired uplighting. The probability of each light ray striking a particle and being so diverted is proportional to the level of filling of these particles in the reflector material. The percentage of the light entering the reflector material that appears as uplight is easily adjusted by adjusting the amount of particles added to the molding material.

Once a light ray is diverted by a particle, it is highly probably that the ray will pass through one or the other of the prism surfaces 36 or 38. This is the case because the path to achieve total internal reflection is rather critical, typically having a tolerance of only 3 to 5 degrees, and there is a low probability that the diverted ray will be oriented within this narrow range. To schematically illustrate this effect, FIG. 3 shows a light ray 150 being diverted by a particle 151 and thus caused to pass through prism surface 36 rather than being reflected by such surface.

Specific examples of reflective particles that are suitable for use as additives for a plastic reflector material are particles of titanium dioxide and magnesium oxide. Another example of an additive that can be used in acrylic and other plastic reflector materials is beads of barium titanate glass. These beads have a substantially different index of refraction from the acrylic material (i.e., about 1.9 versus about 1.46 for acrylic material). Such beads can be obtained from Potters Industries, Hasbrouk Heights, N.J. as its H series of glass beads. Any type of glass bead having an index of refraction different enough from that of the plastic reflector material to divert the light path at least 3 or 4 degrees will usually be suitable as an additive to the plastic reflector material.

The following table provides examples of the results achieved with a suitable particle additive present in specified amounts, when used for a reflector of the design shown in FIGS. 1–3, but without the cover 60. The additive used is a commercially-available color concentrate sold by Continental Polymers of Compton, Calif. under the designation specified in the table.

| Reflector Material | Additive | Volume Percentage of Additive | Uplighting as a Percentage of Lumen Output of Luminaire |
|---|---|---|---|
| Acrylic Resin | None | None | 14.7 |
| Acrylic Resin | CP82-White 68023 | 1.0 | 19.3 |
| Acrylic Resin | CP82-White 68023 | 2.5 | 32.5 |

While the above table mentions only acrylic resin as the reflector material, other plastics are also suitable as reflector materials, depending on the light sources and operating temperatures. Examples are polystyrene, polycarbonate, polyethylene, and butyrate. Manufacturers of these materials typically make available color concentrates similar to that specified in the table which may be added to the plastic reflector material to achieve similar results.

It will be apparent that whether or not the luminaire includes about its reflector a cover such as the above-described cover 60, the addition of the light-dispersing particles to the material of the reflector is effective in controlling the amount of light permitted to pass through the prismatic outer surface of the reflector and, hence, is effective in establishing the uplighting capabilities of the luminaire. Accordingly, my invention in its broader aspects is applicable to a luminaire with or without a cover such as 60. It is to be understood, however, that there is a special cooperative relationship between the light-dispersing particles and the cover since the particles initially establish the proportions by which light from the source will be divided between uplight and downlight, and the cover acts to maintain this division substantially constant during use of the luminaire, assuming the cover is kept reasonably clean. Even if the cover is not kept as clean as might be desired, the cover will nevertheless still be effective to maintain substantially unchanged the amount of downlight established by the presence of the light-dispersing particles in the reflector material.

While the reflector of the illustrated embodiment has a vertically oriented axis, it is to be understood that the invention in its broader aspects is applicable to luminaires in which the reflector is otherwise disposed, for example, with its axis inclined or even horizontal.

It is further noted that while the prisms 33 of the illustrated reflector 16 respectively extend in planes that include the central longitudinal axis 21 of the reflector, the invention in its broader aspects is also applicable :o reflectors in which the Prisms extend along paths that have somewhat different configurations, e.g., paths that have a slight helical component.

As used herein, the expression "right-angle prism" is intended to denote a prism having reflecting surfaces oriented so that the angle included therebetween is an angle of 90 degrees plus or minus a 5 degree tolerance.

While I have shown and described particular embodiments of my invention, it will be obvious to those skilled in the art that various changes and modifications may be made without departing from my invention in its broader aspects; and 1, therefore, intend herein to cover all such changes and modifications as fall within the true spirit and scope of my invention.

What I claim is:

1. In a luminaire comprising a reflector of substantially transparent material and means for mounting a light source within said reflector, the reflector having a prismatic outer surface that has many double-reflecting prisms located at juxtaposed spaced locations along said outer surface, the individual prisms being characterized by having two reflecting surfaces that are disposed so that a large percentage of the rays from said source entering the individual prisms strike said reflecting surfaces at angles of incidence greater than the critical angle of incidence, thereby totally internally reflecting a large percentage of said light from said source, the improvement comprising:

means for controlling the amount of light passing from said source through said prismatic outer surface comprising an additive in particle form dispersed at least partially randomly within said transparent reflector material and serving to divert some of the light rays from said source into paths that intersect said reflecting surfaces at angles less than said critical angle of incidence, thereby causing said diverted rays to pass through said prismatic outer surface.

2. A luminaire as defined in claim 1 and further comprising:

(a) a cover of substantially transparent material for the reflector located externally of said prismatic outer surface and of a shape generally conforming to that of said reflector, and (b) means for mounting said transparent cover closely adjacent the prismatic outer surface of said reflector in such a manner that said cover is spaced from said prismatic outer surface at substantially all points on the prism reflecting surfaces where said prism reflecting surfaces are disposed to effect total internal reflection of the light source rays.

3. The combination of claim 2 in which the reflecting surfaces of each prism meet at an apex and said transparent cover engages said prisms only at the apices thereof.

4. A luminaire as defined in claim 1 in which the individual prisms are further characterized by having their reflecting surfaces oriented so that most of the light rays from said source entering a prism strike the reflecting surfaces at angles of incidence greater than the critical angle of incidence, thereby totally internally reflecting most of the light from said source entering the prism.

5. A luminaire as defined in claim 1 in which such double-reflecting prisms are further characterized by being right-angle prisms.

6. A luminaire as defined in claim 1 in which said substantially transparent material is a plastic material.

7. A luminaire as defined in claim 1 in which said substantially transparent material is a plastic material selected from the group consisting of the following resins: acrylic, polystyrene, polycarbonate, polyethylene and butyrate.

8. A luminaire as defined in claim 1 in which said substantially transparent material is a plastic material and said additive comprises a material having an index of refraction different enough from that of the plastic reflector material to divert light rays through said reflector material by at least three degrees when said rays encounter said additive.

9. A luminaire as defined in claim 8 in which said additive comprises glass beads.

10. A luminaire as defined in claim 1 in which said additive comprises particles of light-reflective material.

11. A method of controlling the amount of light from a light source passing through the prismatic outer surface of a reflector of substantially transparent solid material that is adapted to surround said source, the prismatic outer surface having many double-reflecting prisms at juxtaposed spaced locations along said outer surface, the individual prisms being characterized by having two reflecting surfaces that are disposed so that a large percentage of the rays from said source entering a prism strike said reflecting surfaces at angles of incidence greater than the critical angle of incidence, thereby totally internally reflecting a large percentage of the light from said source, the reflector being formed from a material that is initially in a miscible state, said method comprising:

(a) adding to said reflector material while in its miscible state solid particles, and (b) dispersing said particles throughout said miscible-state material so that when said material is solidified to form said reflector, said dispersed particles serve to divert light rays from said source into paths that intersect said reflecting surfaces at angles less than said critical angle of incidence, thereby causing said diverted rays to pass through said prismatic outer surface and produce uplight.

12. The method of claim 11 in which said substantially transparent material is a plastic material.

13. The method of claim 11 in which said substantially transparent material is a plastic material selected from the groups consisting of the following resins: acrylic, polystyrene, polycarbonate, polyethylene, and butyrate.

14. The method of claim 11 in which said substantially transparent material is a plastic material and said additive is a material having an index of refraction different enough from that of the plastic reflector material to divert light raYs through said reflector material by at least three degrees when said rays encounter said additive.

15. The method of claim 14 in which said additive comprises glass beads.

16. A method as defined in claim 11 in which the uplighting as a percentage the lumen output of the luminaire is controlled as a direct function of the percentage of solid particles included in the reflector material.

17. In a luminaire comprising a reflector of substantially transparent material and means for mounting a light source within said reflector, the reflector having a prismatic outer surface that has many double-reflecting prisms located at juxtaposed spaced locations along said outer surface, the individual prisms being characterized by having two reflecting surfaces that are disposed so that a large percentage of the rays from said source entering the individual prisms strike said reflecting surfaces at angles of incidence greater than the critical angle of incidence, thereby totally internally reflecting a large percentage of said light from said source, the improvement comprising:

means for controlling the amount of light transmitted through said prismatic outer surface comprising an additive in particle form dispersed within said transparent reflector material and serving to divert some of the light rays from said source into paths that intersect said reflecting surfaces at angles less than the critical angle of incidence, thereby causing said diverted rays to pass through said prismatic outer surface;

a cover of substantially transparent material disposed about the reflector and located externally of said prismatic outer surface; and, wherein the reflecting surfaces of each prism meet at an apex and said transparent cover engages said prisms only at the apices thereof.

18. A luminaire as claimed in claim 17 wherein said reflector and said cover have respective annularly formed neck portions which are sized in a complimentary manner such that the annular neck portion of said cover fits about said annular neck portion of said reflector in a sealed manner.

19. A luminaire as claimed in claim 18 further comprising filter means disposed on said cover and effective for filtering air flow that may occur between atmosphere and an air space formed between said cover and said reflector.

20. A luminaire as claimed in claim 19 wherein said air space is formed between said cover and said reflector by said cover contacting only said apices formed when said reflecting surfaces of each prism meet thereby leaving a space between said cover and all points on said reflector that are below said apices.

* * * * *